US008680783B2

(12) United States Patent
Athalye

(10) Patent No.: US 8,680,783 B2
(45) Date of Patent: Mar. 25, 2014

(54) BIAS VOLTAGE GENERATION USING A LOAD IN SERIES WITH A SWITCH

(75) Inventor: Praneet Jayant Athalye, Morrisville, NC (US)

(73) Assignee: Cree, Inc., Durham, NC (US)

( * ) Notice: Subject to any disclaimer, the term of this patent is extended or adjusted under 35 U.S.C. 154(b) by 210 days.

(21) Appl. No.: 13/207,204

(22) Filed: Aug. 10, 2011

(65) Prior Publication Data

US 2013/0038242 A1 Feb. 14, 2013

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 37/00*** | (2006.01) |
| ***H05B 39/00*** | (2006.01) |
| ***H05B 41/00*** | (2006.01) |

(52) U.S. Cl.
USPC ..... 315/294; 315/312

(58) Field of Classification Search
None
See application file for complete search history.

(56) References Cited

U.S. PATENT DOCUMENTS

| | | | |
|---|---|---|---|
| 5,811,963 | A | 9/1998 | Elwell |
| 6,459,174 | B1 | 10/2002 | Marino |
| 6,859,021 | B2 | 2/2005 | Link |
| 2007/0024213 | A1 | 2/2007 | Shteynberg et al. |
| 2007/0229001 | A1 | 10/2007 | McIntosh et al. |
| 2008/0018261 | A1 | 1/2008 | Kastner |
| 2009/0295228 | A1 | 12/2009 | Ochi |
| 2010/0039083 | A1 | 2/2010 | Moriarty, Jr. |
| 2010/0079124 | A1 | 4/2010 | Melanson |
| 2010/0194285 | A1 | 8/2010 | Byun et al. |
| 2011/0109241 | A1 * | 5/2011 | Kitamura ..... 315/291 |

FOREIGN PATENT DOCUMENTS

| | | |
|---|---|---|
| EP | 0709950 | 5/1996 |
| WO | WO 02/43244 | 5/2002 |
| WO | WO 2006/031810 A2 | 3/2006 |
| WO | WO 2009/142478 A2 | 11/2009 |
| WO | WO 2012/016207 A1 | 2/2012 |
| WO | WO 2012/016221 A2 | 2/2012 |
| WO | WO 2012/027507 A2 | 3/2012 |

OTHER PUBLICATIONS

STMicroelectronics (www.st.com) L6562A, "Transition-mode PFC controller", Aug. 2007, pp. 1-26, http://www.st.com/internet/com/TECHNICAL_RESOURCES/TECHNICAL_LITERATURE/DATASHEET/CD00151385.pdf.

International Search Report and Written Opinion for International Application No. PCT/US2012/049845 mailed Nov. 7, 2012.

* cited by examiner

*Primary Examiner* — Douglas W Owens
*Assistant Examiner* — Dedei K Hammond
(74) *Attorney, Agent, or Firm* — Brinks Gilson & Lione

(57) ABSTRACT

A power supply includes a load connected in series with a switch. The power supply uses the load in series with the switch to maintain a substantially constant voltage. The voltage may be used as a voltage bias and supplied to a controller module that is used to control switching of the switch. The load is operable to maintain a substantially constant voltage at an input terminal of the load and also to function as a current sink. The load may also perform an additional function, such as provide auxiliary lighting or operate as a cooling mechanism for the power supply and/or a lighting system that includes the power supply.

23 Claims, 4 Drawing Sheets

BIAS VOLTAGE GENERATION USING A LOAD IN SERIES WITH A SWITCH

TECHNICAL FIELD

The present disclosure relates generally to power converters, and more particularly to a load in series with a switch that supplies a bias voltage.

BACKGROUND

Power supplies may be used in electronic applications to convert an input voltage to a desired output voltage in order to power one or more electronic devices. The power supplies that perform the voltage conversion may be linear power supplies or switched-mode (or switching) power supplies (SMPS). A linear power supply provides a desired output voltage by dissipating excess power in ohmic losses, such as by dissipating heat. A switching power supply may be substantially more efficient than a linear power supply because of the switching action.

Switching power supplies may include a boost inductor in connection with the switch. When the switch is on, the boost inductor is being charged. When the switch is off, the energy stored in the boost inductor is sent to the output of the switching power supply. Operation of the switch may be controlled by a controller module. The controller module is powered using a bias voltage that is drawn from the input voltage. Typically, the voltage required to power the controller module is much lower than the input voltage. In order to step-down the voltage, a resistor having a large resistance or a transistor operating in the linear region may be used. However, using these approaches results in large amount of power being wasted and dissipated as heat.

To have an efficient bias voltage generation, a boost inductor having a main winding and an auxiliary winding may be used. With both the main winding and the auxiliary winding, the boost inductor, functioning as a transformer, transfers charge from the main winding of the inductor to the auxiliary winding. The auxiliary winding uses the charge to supply bias to the controller module. A turns ratio of the main and auxiliary windings is a critical feature of the inductor. In order to have the correct turns ratio, the inductor is often custom manufactured since off-the-shelf inductors having the required turns ratio may not be available. However, the manufacture of custom inductors may be costly.

DETAILED DESCRIPTION

The present disclosure describes a load in series with a switch in a power supply, such as a switched-mode power supply (SMPS) that generates and/or maintains a voltage. The voltage may be a voltage bias and may be supplied to a controller module that controls switching of a switch in the power supply. The voltage bias that is generated and/or maintained by the load may be a voltage or a range of voltages that is required and/or predetermined to power the controller module. The load may also function as a current sink. The load and/or the switch may be connected to energy storing circuitry. In an example operation of the power supply, current supplied from the switch when the switch is on may charge the energy storing circuitry. The charge may be discharged from the energy storing circuitry and flow into the load. While the switch is switching on and off, the load, in connection with the energy storing circuitry, may operate to generate and/or maintain a constant or substantially constant voltage.

The load may be an electronic device and/or electronic component or plurality of electronic devices and/or electronic components. In addition or alternatively, the load may be an active device. The load may be operable to maintain a substantially constant voltage at an input terminal of the load and that functions as a current sink. Non-limiting examples include one or more solid state light emitters such as light emitting diodes ("LEDs"), one or more cooling systems, one or more zener diodes, linear circuitry, one or more pulse-width-modulated (PWM) converters, or any combination thereof. The PWM converter may be operated to maintain a substantially constant voltage at an input of the PWM converter, and may also be operated to supply current to a load at an output of the PWM converter. Preferably, the load performs a function in addition to maintaining the voltage bias. For example the LEDs may provide an auxiliary light source, and the cooling system may prevent the SMPS circuitry from overheating.

An example SMPS that may include a load in series with a switch that generates and/or maintains a voltage bias is a boost converter. A boost converter (also referred to as a step-up converter) is a type of SMPS that generates an output DC voltage that is greater than an input DC voltage. Other power converters such as buck (step-down) and buck-boost (step-up-down) may be used, including those that perform AC-DC, DC-AC, and AC-AC conversion.

Figure 1:
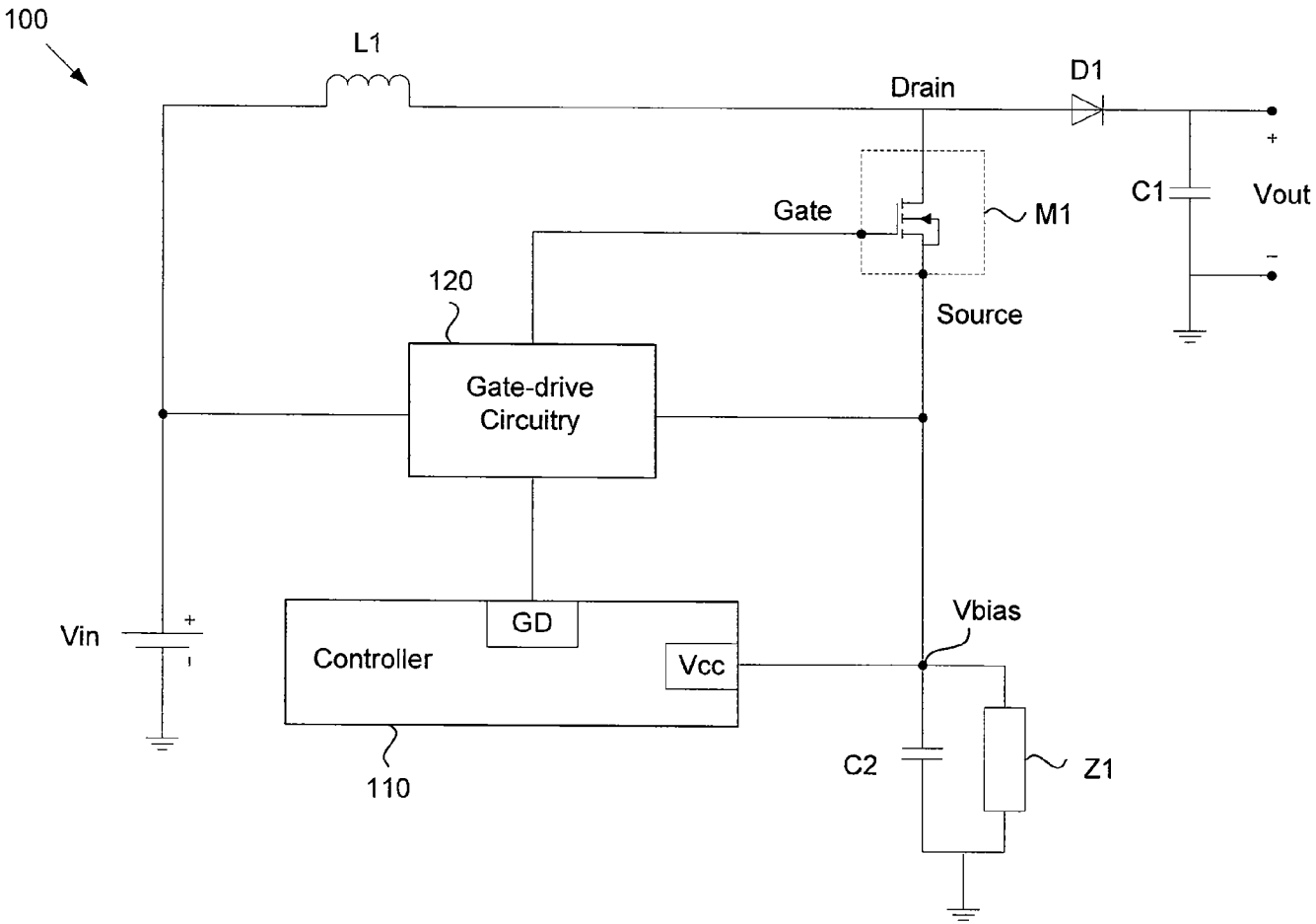
FIG. 1 shows a diagram of a switched-mode power supply that includes a load connected in series with a switch.

FIG. 1 illustrates a circuit diagram of an example SMPS 100 that includes a load Z1 in series with a switch M1 that generates and/or maintains a voltage bias. The switch M1 may be an electronic component or device that switches between an "on" state and an "off" state. In one example, the switch M1 is an electronic component or device that switches between being completely "on" and completely "off." When the switch M1 is completely on, the current provided from a boost inductor L1 is passed through the switch M1. In one example as shown in FIG. 1, the switch M1 is a metal-oxide-semiconductor field-effect transistor (MOSFET). A signal may be applied to a gate of the MOSFET to turn the switch M1 "on" and "off"

The load Z1 may be one or more electronic devices and/or components that may be configured to maintain a constant or substantially constant voltage at an input terminal of the load and that functions as a current sink. While functioning as a current sink, current may pass through the load, which generates the constant or substantially constant voltage. As non-limiting examples, the load may be one or more LEDs, one or more cooling systems, one or more zener diodes, or any combination thereof. Where the load comprises a plurality of LEDs, the LEDs are connected in series. Preferably, the LEDs are included as a single packaged component. An example is a Cree MX-6S LED. Alternatively, the LEDs are included as separate packaged components, or any combination of LEDs packaged as single components and LEDs packaged together.

Preferably, the load provides a function in addition to generating the voltage Vbias at the input terminal. In one example, the load may actively control optical and/or thermal characteristics of a lighting device and/or a lighting system. Optical and/or thermal characteristics may include color, brightness, and/or temperature, as examples. Alternatively or in addition, the load may provide optical and/or thermal energy to the lighting device and/or the lighting system. The lighting device and/or the lighting system may be part of or may include the SMPS 100. For example, the lighting device and/or the lighting system may include the SMPS 100 and a light source connected to an output, such as the Vout terminals, of the SMPS 100. In addition or alternatively, the one or more LEDs may provide an auxiliary light source. When current is supplied to the LEDs, a substantially constant voltage is generated across each of the LEDs and light is emitted from the LEDs. If more than one LED is used, the LEDs are connected in series. Any number of LEDs may be used, and the amount may depend on design parameters, such as light output, the bias voltage Vbias, and/or properties of the switch M1. For example, if Vbias is determined and/or required to be 16 V, then five LEDs each operating at 3.2 V when turned on may be used. In another example function, the cooling system may provide temperature control that prevents the SMPS circuitry from overheating.

The SMPS 100 further includes a controller module 110 that controls switching of the switch M1. A switching signal is output from an output terminal GD to switch the switch M1 "on" and "off" and/or to control the duty cycle of the switch M1. The switching signal may be any type of signal that can turn the switch M1 "on" and "off." The switching signal may be a pulse-width modulated (PWM) signal. The switching signal is sent from the output terminal GD to the switch M1 via gate-drive circuitry 120. For the SMPS 100 shown in FIG. 1 where the switch M1 is a MOSFET, switching is controlled by applying a voltage to a gate terminal of the MOSFET. When the voltage that is applied to the gate generates a gate-to-source voltage that exceeds a threshold voltage, the switch M1 is turned "on." When the voltage applied to the gate generates a gate-to-source voltage that is below the threshold voltage, the switch is turned "off."

In addition, as shown in FIG. 1, the controller module 110 includes a voltage bias input terminal Vcc. The voltage bias input terminal Vcc is configured to receive a voltage Vbias that is used to power the controller module 110. The voltage Vbias may be any amount as determined and/or required by the controller module 110. In one example, the voltage required by the controller module 110 is of an order much less than the input voltage Vin. For example, the voltage Vbias may be in the range of one-twentieth to one-fifth of the input voltage Vin.

The SMPS 100 further includes a boost inductor L1 and a diode D1 that are in electrical communication with the switch M1. In the SMPS 100 shown in FIG. 1 where the switch M1 is a MOSFET, the boost inductor L1 and the diode D1 are connected to a drain of the MOSFET. Also, as shown in FIG. 1, a boost inductor L1 is in communication with an input DC voltage source Vin. In operation, when the switch M1 is on, the boost inductor L1 is being charged from the input voltage source Vin, and the diode D1 is off. When the switch M1 is turned off, the diode D1 is on. Charge that is stored in the boost inductor L1 is sent to the diode D1, and the diode D1 sends the charge that it receives from the boost inductor L1 to an output capacitor C1.

The SMPS 100 further includes energy storing circuitry that is connected to the load Z1. The energy storing circuitry may be or may include one or more circuit elements, such as one or more capacitors, inductors, resistors, diodes, transistors, other circuit elements, or any combination thereof, that is capable of storing and discharging energy. The energy storing circuitry may be connected to the load Z1 so that voltage is maintained at the node Vbias. An example energy storing circuitry, as shown in FIG. 1, may be a capacitor C2 connected in parallel with the load Z1 and connected in series with the switch M1. In operation, when the switch M1 is "on," charge from the boost inductor L1 flows through the switch M1 to the capacitor C2, where the charge is stored. The load Z1 functions as a current sink and the charge that is stored in the capacitor C2 is discharged and supplied to the load Z1. Additionally, some charge stored in the capacitor C2 may also be discharged into the voltage bias input terminal Vcc of the controller module 110. Without the load Z1, charge would only be discharged into the voltage bias input terminal Vcc, resulting in more charge being stored in the capacitor C2 than being discharged, and causing the voltage Vbias to continually increase. By positioning the load Z1 in parallel with the capacitor C2, at steady state, the amount of charge flowing into the capacitor C2 from the switch M1 is about the same as the charge being discharged from the capacitor C2 and into the load Z1 and/or the input terminal Vcc, resulting in the voltage Vbias being maintained at a substantially constant voltage. In this regard, the load Z1 functions as a voltage regulator.

As shown in FIG. 1, the parallel combination of the capacitor C2 and the load Z1 is in communication with the voltage bias input terminal Vcc. The constant or substantially constant voltage Vbias that is maintained by the load Z1 is supplied to the input terminal Vcc and used to power the controller module 110. When used to power the controller module 110, the constant or substantially constant voltage Vbias may be a voltage within an operating range of the controller module 110. The operating range may be a parameter of the controller module 110 and may determine a bias voltage range in which the controller module 110 may operate and/or be powered. The constant or substantially constant voltage being generated and/or maintained by the parallel combination of the capacitor C2 and the load Z1 may be a voltage that is within the operating range of the controller module 110 and may not be a voltage that falls below the operating range, such as below a minimum operating voltage (also referred to as an under voltage lockout (UVLO)).

The value of C2 may be based on a value that yields low ripple voltage. As the switch M1 is turned on and off, the amount of charge that is charging the capacitor may change. In general, the larger the capacitance of C2, the less the capacitor is charging and discharging and the less amount of voltage ripple across the capacitor C2. As a result, there is a lower amount of current ripple through the load Z1 and a more steady constant voltage that is maintained.

The SMPS 100 further includes gate-drive circuitry 120. As shown in FIG. 1, the gate-drive circuitry 110 is in communication with the output terminal GD, the gate and source terminals of the switch M1, and the input voltage source Vin. The gate-drive circuitry 120 is used to turn the switch M1 "on" and "off." The gate-drive circuitry 120 is configured to receive the switching signal from the controller module. The gate-drive circuitry 120 is further configured to push the voltage of the switching signal above a threshold so that the gate-to-source voltage turns the switch on and/or pull the voltage of the switching signal down below the threshold so that the gate-to-source voltage turns the switch off. As shown in FIG. 1, the source voltage of the MOSFET is tied to the voltage Vbias. The load Z1 may hold the voltage Vbias at a level such that the switching signal that is output from the output terminal GD does not have a large enough voltage to generate a gate-to-source voltage that exceeds the threshold voltage. In order to switch the switch M1 on and off, the gate-drive circuitry 110 is placed in between the output terminal GD of the controller module 110 and the gate terminal of the switch M1 and is configured to push the voltage of the switching signal up above the threshold voltage and pull the voltage of switching signal back down below the threshold voltage.

Figure 2:
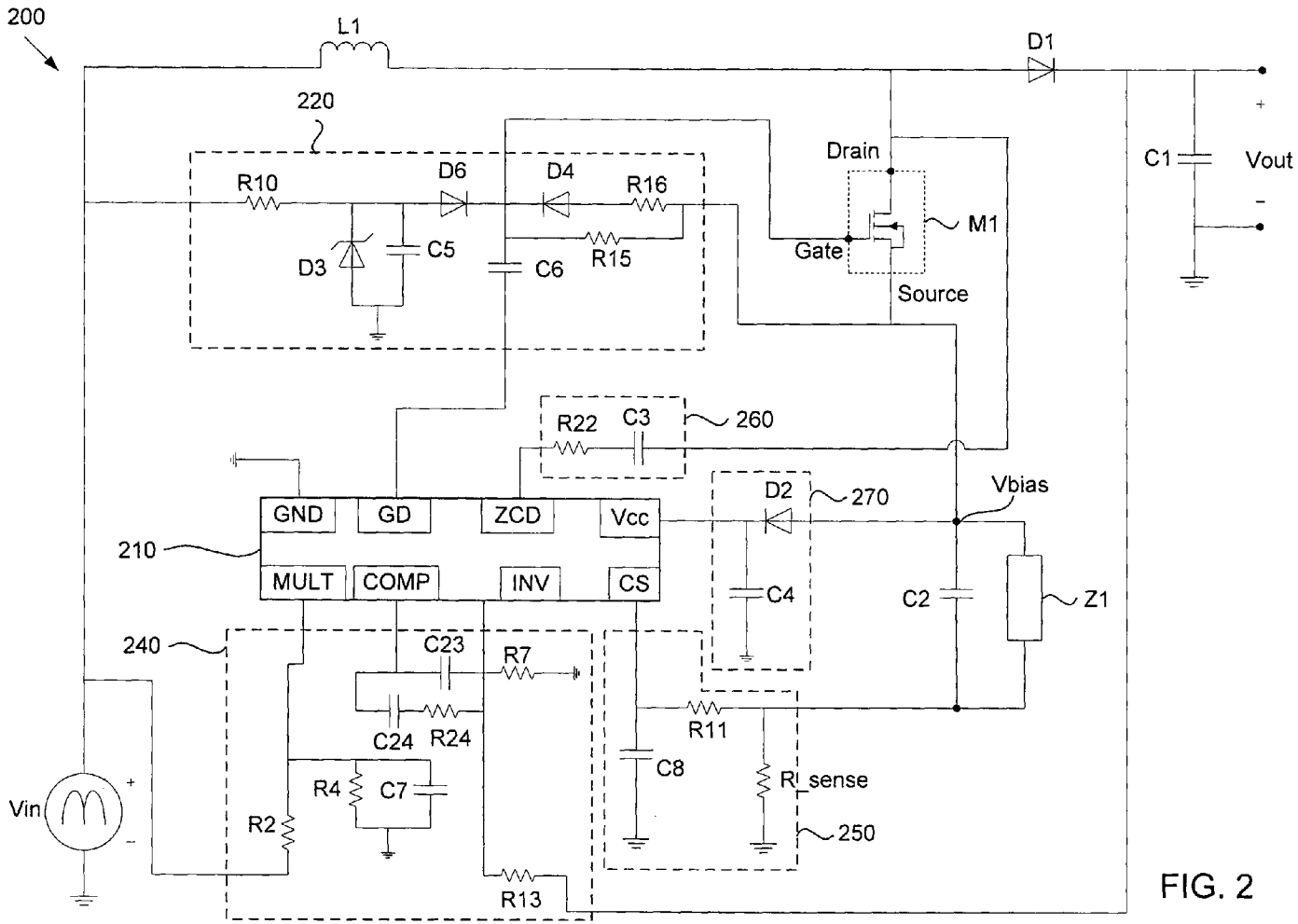
FIG. 2 shows a schematic diagram of an exemplary embodiment of the switched-mode power supply of FIG. 1, illustrating example circuit configurations of gate-drive circuitry and controller module circuitry.

FIG. 2 shows a schematic diagram of an exemplary SMPS 200 that includes a parallel combination of a capacitor C2 and a load Z1 in communication with a switch M1. The SMPS 200 further includes a controller module 210 that outputs a switching signal from an output terminal GD, such as a PWM signal, to turn a switch M1 "on" and "off." The switch M1 may be a MOSFET, although other types of switches capable of being turned "on" and "off" may be used. The controller module 210 also includes a voltage bias input terminal Vcc that receives a voltage for powering the controller module 210. The input terminal Vcc is in communication with the capacitor C2 and the load Z1 and receives the voltage bias that is substantially maintained by the parallel combination of the capacitor C2 and the load Z1. The controller module 210 further includes a current sense input terminal CS, a zero-cross detection input terminal ZCD, an inverting input terminal INV, a compensation input terminal COMP, a multiplier input terminal MULT, and a ground terminal GND, all or some of which may be used by the controller 210 to control the start, stop, and/or duty cycle of the switching signal. An example controller 210 that includes terminals GD, Vcc, CS, ZCD, INV, COMP, MULT, and GND is a transition-mode power factor correction (PFC) controller, such as an STMicroelectronics L6562A controller chip.

The current sense input terminal CS and the zero cross detection terminal ZCD are used by the controller 210 to turn on and shut off the PWM wave that is output from the output terminal GD. As shown in FIG. 2, the input terminal CS is in communication with the parallel combination of the capacitor C2 and the load Z1. The input terminal CS is also in communication with current sense circuitry 250, which includes a resistor R_sense, a capacitor C8, and a resistor R11. The resistor R_sense, the capacitor C8, and the resistor R11 are used to provide a voltage to the input terminal CS that is proportional to the current passing through the switch M1. The input terminal CS senses the current that passes through the switch M1, which is also the current output from the boost inductor L1. When the controller 210 senses at the input terminal CS that the current through the switch M1 has reached a particular threshold current level, the controller 210 is configured to shut off the PWM signal that is output from the GD output terminal. The input terminal ZCD is in communication with the drain terminal of the switch M1 via zero-cross detection circuitry 260, which includes a resistor R22 and a capacitor C3. The controller 210 senses the current flowing into the switch M1 at the input terminal ZCD. When the controller 210 senses at the input terminal ZCD that the current flowing through the switch M1 has dropped to zero, the controller 210 is configured to turn on the PWM signal that is output from the GD output terminal.

The inverting input terminal INV is used to monitor the output of the SMPS 200. Based on the output of the SMPS that is received at the input terminal INV, the transition-mode PFC controller 210 may control the duty cycle of the PWM signal. For example, if the transition-mode PFC controller 210 determines that the output voltage Vout is too high based on the voltage received at INV, the transition-mode PFC controller 210 may decrease the duty cycle of the switching signal that is output from the output terminal GD. Similarly, if the transition-mode PFC controller 210 determines that the output voltage Vout is too low, then the transition-mode controller 210 may increase the duty cycle of the switching signal. The compensation input terminal COMP is used to stabilize the output of the SMPS 200. The compensation input terminal COMP is connected to resistor R6, which functions as a compensation resistor so that the output of the SMPS 200 reaches a steady-state level. The multiplier input terminal MULT is used for power factor correction in order to optimize the power factor and the efficiency of the SMPS 200. The ground terminal GND provides a ground reference for the voltages in the transition-mode PFC controller 210.

The input terminals INV, COMP, and MULT are in communication with compensation network circuitry 240. In addition to the input terminals INV, COMP, and MULT, the compensation network circuitry 240 is also in communication with the input voltage source Vin and the output voltage Vout. The compensation network circuitry 240 includes resistors R2, R4, R7, R24, and R13 and capacitors C7, C23, and C24. The compensation network circuitry 240 is configured as a step-down network that converts the input voltage Vin and/or the output voltage Vout to voltage levels that may be received by the INV, COMP, and/or MULT input terminals and/or processed by the controller 210. The compensation network circuitry 240 may also be used to stabilize the controller 210 and/or the SMPS 200. The configurations are shown as non-limiting examples and may be based on the specifications of the controller 210, the switch M1, and/or the load Z1. Depending on the controller 210, the switch M1, and/or the load Z1, other configurations may be used.

FIG. 2 also shows a schematic diagram of an exemplary circuit configuration of gate-drive circuitry 220. As shown in FIG. 2, the gate-drive circuitry 220 is in communication with the output terminal GD, gate and source terminals of the switch M1, and the input voltage source Vin. In between the gate and source terminals, a resistor R16 and a diode D4 are connected in parallel with a resistor R15. A coupling capacitor C6 is in between the output terminal GD and the gate terminal of the switch M1. A resistor R10 is connected in between the input voltage source Vin and the gate terminal. The resistor R10 is connected in shunt with a parallel combination of a zener diode D3 and a capacitor C5, and is connected in series with a diode D6.

During an initial start up of the SMPS 200, a small current through R10 charges the capacitor C5 and a voltage is maintained across the zener diode D3 and the capacitor C5. In addition, provided that the output terminal GD is at a low state (e.g., 0 volts) at start up, the coupling capacitor C6 is charged to the voltage maintained across the diode D3 and the capacitor C5, which turns the switch M1 "on" because at start up, the voltage across the capacitor C2 is 0 V. Current flows through the boost inductor L1 and the switch M1 to the capacitor C2 and charges the capacitor C2 until the voltage at the source terminal of the switch M1 turns the switch M1 "off" and/or saturates the switch M1. In addition, the capacitor C4 of voltage bias circuitry 270 is charged, at which point the controller 210 is operational.

During normal operation of the SMPS 200 (e.g., after start up and the controller 210 is operational), the voltage maintained across the coupling capacitor C6 is still maintained. Because the coupling capacitor C6 is connected to the output terminal GD, the voltage that is maintained across the coupling capacitor C6 may be added to the voltage of the switching signal that is output from the output terminal GD, which may generate a voltage signal applied to the gate terminal of the switch M1 that is greater than the source voltage of the switch. Switching of the switch M1 may begin when the difference between the gate voltage and the source voltage reaches a threshold voltage level, which turns the switch M1 "on." In one example, the threshold level is about the magnitude of the voltage bias Vbias that is applied to the voltage bias input terminal Vcc. When the switch M1 is "on," the coupling capacitor C6 is discharging. When switch M1 is "off," the coupling capacitor C6 is being charged from the charge that is being discharged from the capacitor C2. The charge from the capacitor C2 is sent through the resistor R16 and the diode D4 to the coupling capacitor C6. In addition, the resistor R15 connected across the gate and source of the switch M1 ensures that M1 remains off by default. The circuitry configuration of the gate-drive circuitry 220 shown in FIG. 2 is a non-limiting example that may be used to push up and/or pull down the voltage that is supplied to the gate of the switch M1 in order to switch the switch M1 on and off. Other configurations may be used.

Table 1 lists some of the components of the exemplary SMPS 200 as shown in FIG. 2 and associated values where the controller module 210 is a STMicroelectronics L6562A transition-mode PFC controller chip.

TABLE 1

| Component | Value/Type |
|---|---|
| M1 | BSP89 |
| L1 | 1.5 mH |
| D1 | ES1F |
| Rsense | 3 Ω |
| C1, C2 | 22 uF |
| D3 | Zener Diode |
| C5 | 10 nF |
| R10 | 499 kΩ |
| C3 | 150 pF |
| R22 | 200 kΩ |
| D2, D4, D6 | 1N4148 |
| C4 | 1 uF |
| R16 | 10 Ω |
| R15 | 4.99 kΩ |
| C6 | 10 nF |
| R11 | 100 Ω |
| C8 | 100 pF |
| R2 | 2 MΩ |
| R4 | 30.1 kΩ |
| C7 | 100 pF |
| R13 | 2 MΩ |
| R7 | 25.5 kΩ |
| C23 | 68 nF |
| C24 | 1 μF |
| R24 | 45.3 kΩ |

The components and associated values listed in Table 1 are merely exemplary and were chosen for a SMPS where the controller module 210 is a STMicroelectronics L6562A transition-mode PFC controller chip, where the input voltage Vin is a rectified AC signal having a root-mean-square (RMS) voltage of 120 $V_{RMS}$, where the output voltage Vout is 200 $V_{DC}$, and where the output power is 10 Watts. Other components and/or values associated with the components may be added, eliminated, and/or modified depending on the controller module 210, the input voltage Vin, the output voltage Vout, and/or the output power that is chosen.

Figure 3:
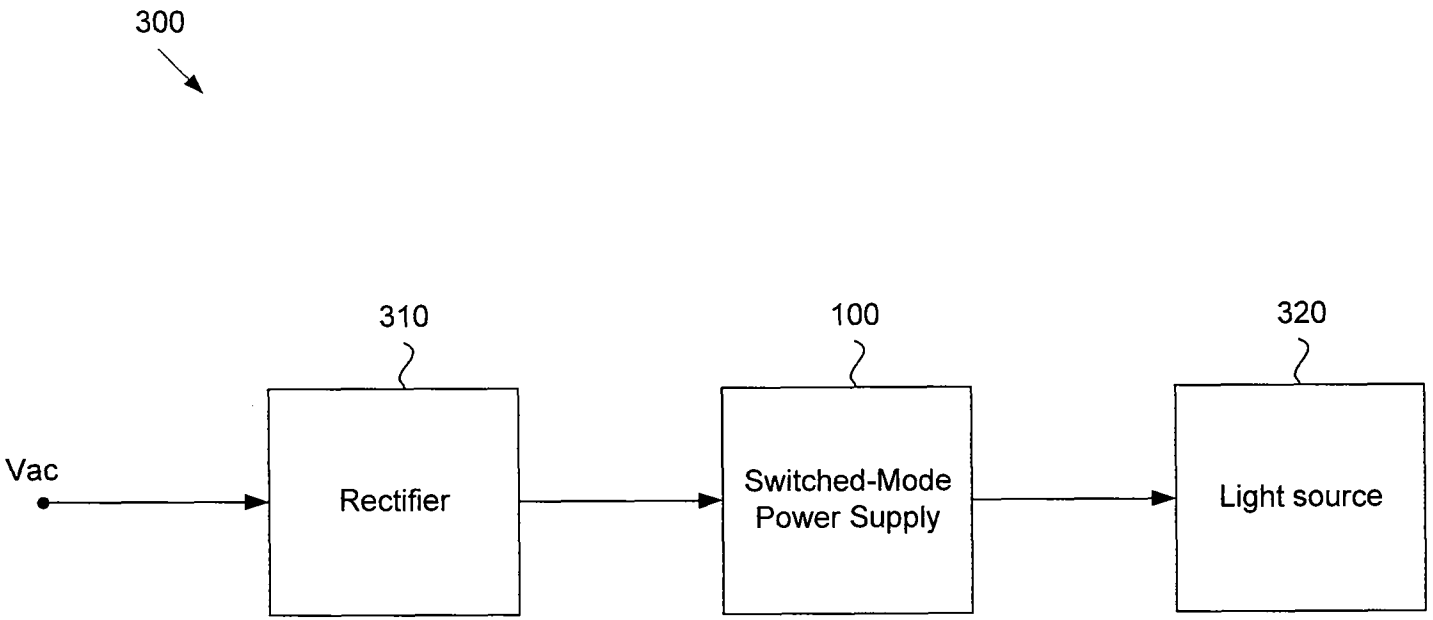
FIG. 3 shows an exemplary lighting system that includes the switched-mode power supply of FIG. 1 connected to a light source.

FIG. 3 shows an example lighting system 300 that includes the SMPS 100. The lighting system 300 further includes a rectifier 310 that provides a rectified DC signal to the SMPS 100. In one example, the SMPS 100 is a boost converter. The lighting system 300 further includes a main light source 320 that is connected to the output of the SMPS 100. In one example, the main light source 320 may comprise one or more LEDs 320 connected in series. In one example, the LEDs 320 are high brightness LEDs, such as Cree XLamp® XP-E LEDs. As shown in FIG. 3, the lighting system 300 may receive an AC input, such as an AC signal from a wall outlet. The AC signal is converted to a rectified AC signal by the rectifier 310. The rectifier 310 may have any configuration as known to one of ordinary skill in the art. The rectified AC signal is sent to the SMPS 100 to convert the rectified AC signal to a DC signal that is used to power the light source 320. As non-limiting examples, the lighting system 300 may be included as part of a downlight, spot light, light bulb, lamp, light fixture, sign, retail display, transportation, lighting for emergency vehicles, or portable lighting system.

Figure 4:
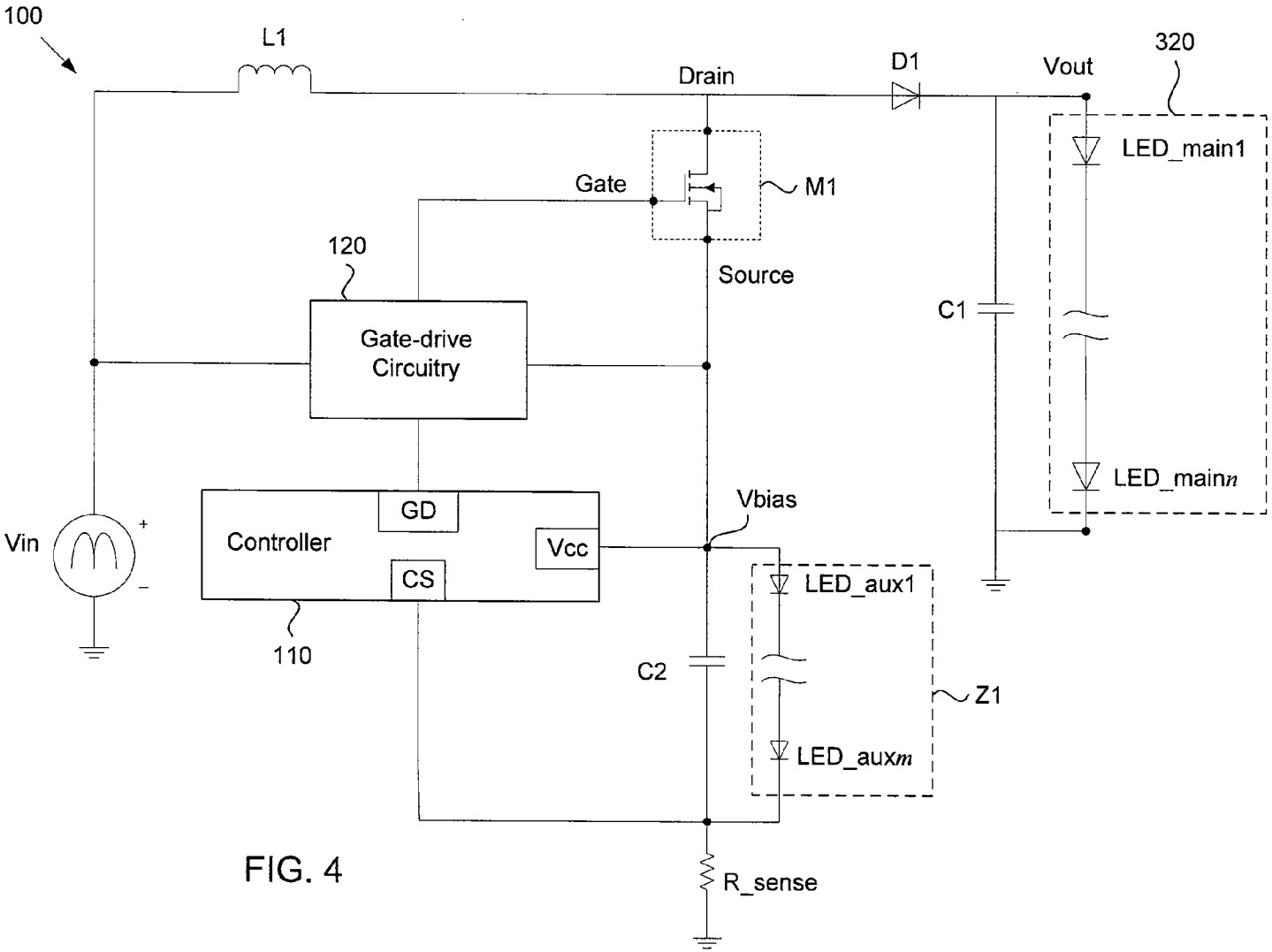
FIG. 4 shows a partial schematic diagram of the switched-mode power supply connected to the light source of the lighting system of FIG. 3, where the load and the light source comprise LEDs.

FIG. 4 shows a partial schematic diagram of the SMPS 100 connected to the light source 320, where the light source 320 and the load Z1 both comprise one or more LEDs. As shown in FIG. 4, the input voltage source Vin is the rectified AC voltage that is output from the rectifier 310 in FIG. 3. Where the light source 320 comprises more than one LED, the plurality of LEDs, LED_main1 . . . LED_mainn, are connected in series with each other and are connected to the main output load of the SMPS 100. The one or more LEDs 320, LED_main1 . . . LED_mainn, function as the main light source of the lighting system 300. Where the load comprises more than one LED, the plurality of LEDs, LED_aux1 . . . . LED_auxm, comprising the load Z1 are connected in series with each other and function to generate and/or maintain a voltage bias that is used to power the controller module 110. In addition, the auxiliary LEDs provide an additional function, which is to provide an auxiliary light source for the lighting system 300. The auxiliary LEDs, LED_aux1 . . . LED_auxm, may be combined with the main LEDs, LED_main1 . . . LED_mainn, for additional light, and/or for mixing light to produce an overall light output of the lighting system. By using the LEDs as the load Z1, a substantially constant voltage is supplied to the input terminal Vcc, and the energy that is used to generate the voltage bias Vbias performs another function (emitting light), rather than being dissipated as heat or merely passed to ground without performing some other function.

In an alternative embodiment, the load Z1 comprises a cooling system. The cooling system is capable of maintaining a substantially constant voltage at an input node and also functions as a current sink. In one example, the cooling system is an active cooling system that includes a fan. In another example, the active cooling system includes a SynJet® module that creates pulsated air-jets that are directed precisely to locations in the SMPS 100 or the system in which the SMPS is implemented, such as the lighting system 300.

In other alternative embodiments or in addition to embodiments where the load Z1 is an auxiliary light source or a cooling system, the load Z1 may be configured to actively control optical or thermal characteristics of the SMPS 100, the light source 320, and/or a lighting device and/or lighting system that includes the SMPS 100 and the light source 320. Alternatively or in addition, the load Z1 may provide optical or thermal energy to the lighting device and/or the lighting system that includes the SMPS 100 and the light source 320.

Various embodiments described herein can be used alone or in combination with one another. The foregoing detailed description has described only a few of the many possible implementations of the present invention. For this reason, this detailed description is intended by way of illustration, and not by way of limitation.

I claim:

1. A power supply comprising:

a switch;

an inductor in communication with the switch, the inductor configured to send charge to a first load when the switch is turned off; and a second load connected in series with the switch, wherein the second load is configured to:

maintain a substantially constant voltage at an input terminal of the second load, and function as a current sink.

2. The power supply of claim 1, further comprising a capacitor that is connected in series with the switch and in parallel with the second load, wherein the capacitor is configured to store charge received from the switch, and wherein the capacitor is configured to discharge the charge to the second load.

3. The power supply of claim 2, wherein the inductor is configured to send charge to the capacitor when the switch is turned on.

4. The power supply of claim 1, further comprising a controller module that is configured to control switching of the switch, wherein the controller module comprises an input terminal in communication with the input terminal of the second load, and wherein the substantially constant voltage is applied to the input terminal of the controller module.

5. The power supply of claim 4, wherein the controller module controls switching of the switch by outputting a pulse width modulated (PWM) signal.

6. The power supply of claim 4, further comprising gate-drive circuitry in communication with the controller module and the switch, wherein the gate-drive circuitry is configured to receive a switching signal from the controller module, to push the switching signal to a voltage above a threshold to turn the switch on, and to pull the switching signal to a voltage below the threshold to turn the switch off.

7. The power supply of claim 1, wherein the switch is a metal-oxide-semiconductor field-effect transistor (MOSFET), and wherein the input terminal of the second load is connected to a source terminal of the MOSFET.

8. The power supply of claim 1, wherein the second load comprises an auxiliary light source.

9. The power supply of claim 8, wherein the auxiliary light source comprises one or more light-emitting diodes.

10. The power supply of claim 1, wherein the second load comprises an active cooling system.

11. The power supply of claim 1, wherein the second load is an active device.

12. A lighting system comprising:

a switched-mode power supply (SMPS) comprising:

a switch;

an inductor in communication with the switch;

a load connected in series with the switch; and energy storing circuitry connected to the load and the switch; and a plurality of light-emitting diodes connected to an output of the SMPS, wherein the inductor is configured to send charge to the plurality of light-emitting diodes when the switch is turned off.

13. The lighting system of claim 12, wherein energy storing circuitry in communication with the load is configured to:

maintain a substantially constant voltage at an input terminal of the load, and function as a current sink.

14. The lighting system of claim 12, wherein the energy storing circuitry comprises a capacitor that is connected in series with the switch and in parallel with the load, wherein the capacitor is configured to store charge received from the switch, and wherein the capacitor is configured to discharge the charge to the load.

15. The lighting system of claim 14, wherein the inductor is configured to send charge to the capacitor when the switch is turned on.

16. The lighting system of claim 12, wherein the SMPS further comprises a controller module that is configured to control switching of the switch, wherein the controller module comprises an input terminal in communication with the input terminal of the load, and wherein the substantially constant voltage is applied to the input terminal of the controller module.

17. The lighting system of claim 16, further comprising gate-drive circuitry in communication with the controller module and the switch, wherein the gate-drive circuitry is configured to receive a switching signal from the controller module, and wherein the gate-drive circuitry is further configured to push the switching signal to a voltage above a threshold to turn the switch on, and pull the switching signal to a voltage below the threshold to turn the switch off.

18. The lighting system of claim 12, wherein the switch is a metal-oxide-semiconductor field-effect transistor (MOSFET), and wherein the input terminal of the load is connected to a source terminal of the MOSFET.

19. The lighting system of claim 12, wherein the load comprises one or more light-emitting diodes.

20. The lighting system of claim 12, wherein the load comprises an active cooling system.

21. The lighting system of claim 12, wherein the load comprises a pulse-width-modulated converter.

22. The lighting system of claim 12, wherein the load is configured to actively control at least one of optical characteristics or thermal characteristics of the lighting system.

23. The lighting system of claim 12, wherein the load is configured to provide at least one of optical energy or thermal energy to the lighting system.

* * * * *